US005407790A

United States Patent [19]

Dickerson et al.

[11] Patent Number: 5,407,790

[45] Date of Patent: Apr. 18, 1995

[54] RADIOGRAPHIC SYSTEM FOR ORTHOPEDIC IMAGING

[75] Inventors: Robert E. Dickerson; Phillip C. Bunch, both of Rochester, N.Y.

[73] Assignee: Eastman Kodak Company, Rochester, N.Y.

[21] Appl. No.: 192,084

[22] Filed: Feb. 4, 1994

[51] Int. Cl.[6] ..... G03C 1/08

[52] U.S. Cl. ..... 430/509; 430/139; 430/966; 430/502; 430/496; 430/523; 378/182; 206/809

[58] Field of Search ..... 430/509, 139, 966, 502, 430/496, 523; 378/182; 206/809

[56] References Cited

U.S. PATENT DOCUMENTS

| | | | |
|---|---|---|---|
| H.1,105 | 9/1992 | Jebo et al. | 430/502 |
| 3,842,282 | 10/1974 | Shimoda et al. | 250/468 |
| 4,324,478 | 4/1982 | Fukushima et al. | 354/312 |
| 4,394,771 | 7/1983 | Charrier | 378/172 |
| 4,425,425 | 1/1984 | Abbott et al. | 430/502 |
| 4,425,426 | 1/1984 | Abbott et al. | 430/502 |
| 4,521,904 | 6/1985 | Takano | 378/185 |
| 4,581,535 | 4/1986 | Komaki et al. | 250/327.2 |
| 4,803,150 | 2/1989 | Dickerson et al. | 430/502 |
| 4,853,728 | 8/1989 | Hall | 354/320 |
| 4,889,989 | 12/1989 | Yoshimura et al. | 250/327 |
| 4,900,652 | 2/1990 | Dickerson et al. | 430/502 |
| 4,994,355 | 2/1991 | Dickerson et al. | 430/509 |
| 4,994,837 | 2/1991 | Samuels et al. | 354/299 |
| 4,994,840 | 2/1991 | Hall et al. | 354/324 |
| 4,997,750 | 5/1991 | Dickerson et al. | 430/509 |
| 5,006,875 | 4/1991 | Oemcke et al. | 354/299 |
| 5,021,327 | 6/1991 | Bunch et al. | 430/496 |
| 5,108,881 | 4/1992 | Dickerson et al. | 430/502 |
| 5,189,455 | 2/1993 | Seim | 354/297 |
| 5,238,795 | 8/1993 | Metoki | 430/502 |
| 5,252,443 | 10/1993 | Dickerson | 430/502 |
| 5,268,251 | 12/1993 | Sakuma | 430/139 |

FOREIGN PATENT DOCUMENTS

| | | |
|---|---|---|
| 530129 | 7/1954 | Belgium . |
| 84303405 | 11/1984 | European Pat. Off. . |
| 017464 | 10/1957 | Germany . |

OTHER PUBLICATIONS

*Research Dis. vol. 184, Aug. 1979, Item 18431,* Section V. Cross-Over Exposure Control.

*Primary Examiner*—Thomas R. Neville
*Attorney, Agent, or Firm*—Anne B. Kiernan

[57] ABSTRACT

A system for orthopedic imaging is disclosed which consists of a supply of low crossover sensitometrically asymmetric radiographic elements and cassettes with various front and back intensifying screens to produce optimal bone images and useful images of surrounding flesh.

25 Claims, 3 Drawing Sheets

RADIOGRAPHIC SYSTEM FOR ORTHOPEDIC IMAGING

FIELD OF THE DISCLOSURE

The invention relates to radiographic imaging. More specifically, the invention relates to an orthopedic radiographic imaging system having cassettes and radiographic elements.

BACKGROUND

In medical radiography, although there are several kinds of radiographic elements that have been optimized for specific exam types in orthopedic imaging, they have not come into common usage by radiologists because most radiologists prefer to use a single kind of radiographic element for all orthopedic exam types, even though that single kind of radiographic element may be optimized for only one orthopedic exam type. Orthopedic exam types include, for example, Extremity Imaging, Imaging of the Knees and Shoulders and Imaging of the Lateral Cervical Spine. Stocking several radiographic elements for the various exam types in orthopedic imaging results in greater expense for storage and increased chances that the technicians will err and use the incorrect radiographic element for a particular exam type. When many different kinds of radiographic elements are stocked, the technicians may be required to load the radiographic elements into the cassettes by hand in a darkroom, which can be inconvenient and further increase the chances of error by the technicians.

Many kinds of the radiographic elements used for orthopedic imaging do not record useful images of the surrounding flesh when they record bones, because the contrast levels of the radiographic elements are too high to provide exposure latitude sufficient to capture both bone and the surrounding flesh in a single image. As a result, the surrounding flesh is imaged too darkly and as such is barely perceptible under standard light box illumination. Other radiographic elements used for orthopedic imaging use films with lower contrast to better image the surrounding soft tissue of interest. As a result, however, bone detail is compromised.

There is a need for a radiographic system that can record optimum images of bones and useful images of the surrounding flesh using a single radiographic element for many orthopedic exam types.

SUMMARY OF THE INVENTION

The present invention satisfies the above-described need by providing a radiographic system for orthopedic imaging which uses a single radiographical element in a plurality of cassettes. This system produces optimum images of bones and useful images of the surrounding flesh for the various exam types in orthopedic imaging.

This radiographic system for orthopedic imaging consists of a store of low crossover sensitometrically asymmetrical radiographic elements, and a plurality of cassettes. Each low crossover sensitometrically asymmetrical radiographic element has nominally the same composition consisting of at least one emulsion layer on both the back and front sides of a support. Each cassette has a housing, front and back intensifying screens and a receiving site disposed between said front and back intensifying screens for the radiographic element. When the low crossover sensitometrically asymmetrical radiographic element is loaded into a cassette, the photicity ratio of the back emulsion layer-back intensifying screen to the front emulsion layer-front intensifying screen is between 2–5, 5–9 or 9–16. The system of this invention consists of one type of low crossover sensitometrically asymmetric radiographic element and at least two cassettes which in combination with the radiographic element provide photicity ratios which differ by greater than 1 and fall within at least two of the above-specified ranges of photicity ratios.

DESCRIPTION OF A SPECIFIC EMBODIMENT

Figure 1:
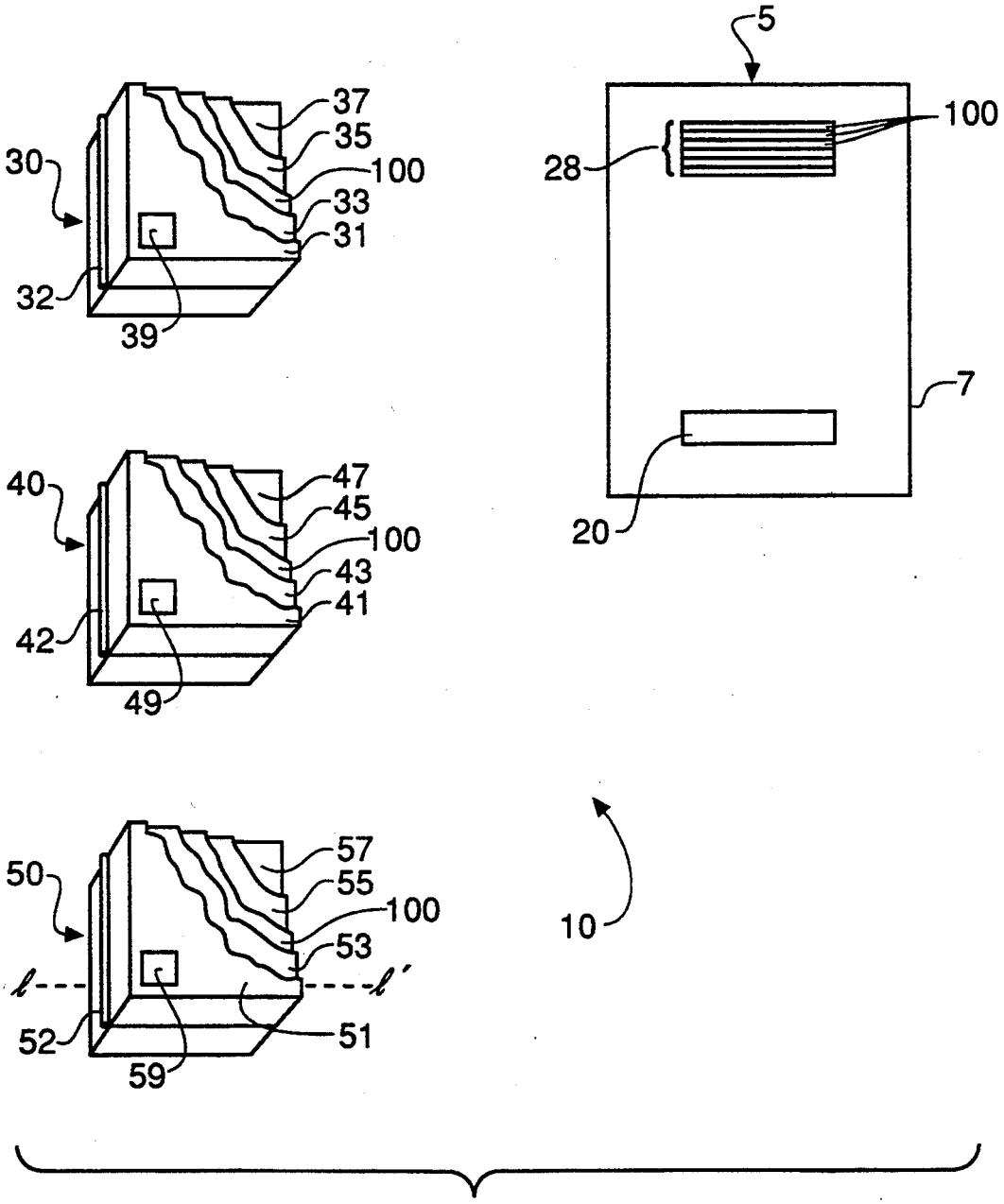
FIG. 1 is a diagramatical view of the radiographic system for orthopedic imaging with cutaway views of cassettes into which a low crossover asymmetrical radiographical element has been loaded.

The term "cassette" refers to an article having a housing, front and back intensifying screens inside of the housing, and space between the intensifying screens for receiving a radiographic element.

The term "double coated" as applied to a radiographic element means that at least one emulsion layer is coated on each of the two opposite sides of the support.

The term "low crossover" as applied to double coated radiographic elements indicates a crossover of less than 10% of the electromagnetic radiation capable of forming a latent image in the emulsion layers of the radiographic element as determined by the procedures set forth in Abbott et al U.S. Pat. Nos. 4,425,425 and 4,425,426, incorporated herein by reference.

The term "sensitometrically symmetric" means that the emulsion layer on opposite sides of a double coated radiographic element produce identical characteristic curves of density versus the logarithm of the exposure when identically exposed.

The term "sensitometrically asymmetric" means that the emulsion layer on opposite sides of a double coated radiographic element produce significantly different characteristic curves of density versus logarithm of the exposure when identically exposed.

The term "photicity" means the integrated product of (1) the total emission of the screen over the wavelength range to which the emulsion layer is responsive, (2) the sensitivity of the emulsion layer over this emission range, and (3) the transmittance of radiation between the screen and its adjacent emulsion layer over this emission range. Transmittance is typically near unity and can in this instance be ignored. Photicity is discussed in greater detail in Mees, *The Theory of the Photographic Process,* 3rd Ed., Macmillan, 1966, at page 462, here incorporated by reference.

This invention provides a radiographic system for orthopedic imaging which consists of a store of low crossover sensitometrically asymmetrical radiographic elements, and a plurality of cassettes. Each low crossover sensitometrically asymmetrical radiographic element has nominally the same composition consisting of at least one light-sensitive emulsion layer on both the back and front sides of a support. The term "nominally the same composition" used herein refers to radiographic elements which have similar enough sensitometric characteristics to provide radiographic images which are identical or that have differences that are irrelevant or insubstantial for the purposes of radiographic examination. An example of such differences are the variations in the radiographic elements as the result of the normal variability in manufacturing processes.

Each cassette has a housing, front and back intensifying screens and a receiving site disposed between the front and back intensifying screens for the low crossover sensitometrically asymmetrical radiographic element. When the cassettes are loaded with the low crossover asymmetrical radiographic element, the photicity ratios of the back emulsion layers-back intensifying screens to the front emulsion layers-front intensifying screens are between 2–5, 5–9, or 9–16. The system of this invention consists of at least two cassettes which provide photicity ratios which differ by greater than 1 and fall within at least two of the three specified ranges of photicity ratios when loaded with the radiographic elements of the system. The orthopedic exam types to be imaged determine which photicity ratios are present in the system of this invention.

The imaging of various bone and surrounding soft tissue structures in orthopedic imaging are grouped together into exam types. The main exam types include the following:

1. Imaging of small bones which have little soft tissue coverage, such as hands and feet. (Soft tissue of flesh includes skin, muscles, tendons, ligaments and fat.)
2. Imaging of larger bones with a medium amount of soft tissue coverage, such as the knees and shoulders.
3. Imaging of the Lateral Cervical Spines of the vertebral column for which it is essential to see all of the vertebrae from C1–C7. Part of the spine is covered with little soft tissue; part of the spine is surrounded with great amounts of soft tissue and bones.

These exam types will be referred to as "Extremity Imaging", "Imaging of Knees and Shoulders" and "Imaging of Lateral C-Spines", but it is understood that the imaging demands of these exam types may be the same for other body parts; therefore, the imaging systems described for these exam types may be used for similar body parts.

For Extremity Imaging, a low crossover sensitometrically asymmetric radiographic element having front and back emulsion layers is loaded into a cassette having front and back intensifying screens so that the front emulsion layer is next to and/or in contact with the front intensifying screen and the back emulsion layer is next to and/or in contact with the back intensifying screen. The photicity ratio of the back emulsion layer-back intensifying screen to the front emulsion layer-front intensifying screen is between 2 and 5. This photicity ratio allows for the recording of very fine detail of bony trabeculae and useful images of the surrounding soft tissue.

For Imaging of Knees and Shoulders, a low crossover sensitometrically asymmetric radiographic element having front and back emulsion layers is loaded into a cassette having front and back intensifying screens so that the front emulsion layer is next to and/or in contact with the front intensifying screen and the back emulsion layer is next to and/or in contact with the back intensifying screen. The photicity ratio of the back emulsion layer-back intensifying screen to the front emulsion layer-front intensifying screen is between 5 and 9. This photicity ratio results in the recording of moderately detailed images of bone and useful images of the surrounding soft tissue.

For Imaging of the Lateral C-Spine, a low crossover sensitometrically asymmetric radiographic element having front and back emulsion layers is loaded into a cassette having front and back intensifying screens so that the front emulsion layer is next to and/or in contact with the front intensifying screen and the back emulsion layer is next to and/or in contact with the back intensifying screen. The photicity ratio of the back emulsion layer-back intensifying screen to the front emulsion layer-front intensifying screen is between 9 and 16. This photicity ratio results in the recording of useful images of all the vertebrae and surrounding soft tissue.

The low crossover sensitometrically asymmetrical radiographic element of the system of this invention can comprise any materials as long as the radiographic element can reduce crossover to less than 10%, preferably less than 5% and optimally less than 3%, and the radiographic element has at least one emulsion layer on the front and back sides of a support. Also, the front and back emulsion layers in conjunction with the front and back intensifying screens within the cassettes must provide the photicity ratios specified above. The "front" preferably designates the side which will face the source of x-rays. The means for reducing the crossover can be achieved by any method know in the art, such as, sensitizing dyes, and cross-over control layers.

Methods to reduce crossover are taught by U.S. Pat. Nos. 4,425,425; 4,425,426; 4,639,411; 4,803,150 and 4,900,652; which are incorporated herein by reference. Examples of low crossover sensitometrical asymmetric radiographic elements which can be used in the system of this invention are disclosed in U.S. Pat. Nos. 5,021,327; 4,994,355 and 4,997,750; which are incorporated herein by reference. The preferred low crossover sensitometrical asymmetric radiographic elements are those that are taught by U.S. application Ser. No. 08/192,082, filed herewith, and incorporated herein by reference.

Additional references which disclose features that may be utilized in the low crossover sensitometrically asymmetric radiographic element of this invention include U.S. Pat. Nos. 4,434,226; 4,439,520; 4,414,304; 4,425,501 and 4,520,098, and *Research Disclosure* Item 18431 and Item 17643, which are incorporated herein by reference.

The cassettes can be constructed from any materials known in the art for this purpose as long as they provide a light-tight housing when closed and space for the front and back intensifying screens and the radiographic element. It is preferred that the cassettes bear some kind of indicia of the intensifying screens they house, including bar codes, symbols or color coding. Examples of cassettes which can be used in the system of this invention are taught by U.S. Pat. Nos. 4,194,625; 4,258,263; 4,259,586; 4,336,961; 4,383,330; 4,538,294; 4,637,043; 4,782,505; 4,813,063; and 5,078,271; which are incorporated herein by reference.

The intensifying screens can be constructed from any known materials in the art for this purpose as long as in conjunction with the emulsions on the radiographic element, they provide the above described photicity ratios. Examples of intensifying screens which can be used in the system of this invention are taught by U.S.

Pat. Nos. 5,021,327; 2,303,942; 4,225,653; 3,418,246; 3,418,247; 3,725,704; 2,729,604; 3,617,743; 3,974,389; 3,591,516; 3,607,770; 2,502,529; 2,887,379; 3,617,285; 3,743,833; 4,259,588 and *Research Disclosure,* Vol. 154, February 1977 Item 15444 and Vol. 182, June 1979, which are all incorporated herein by reference.

One embodiment of the invention is disclosed diagramatically in FIG. 1. The system, 10, is shown as comprising a loader, 5, which has a store or supply, 28, of individual radiographic elements, 100, and cassettes, 30, 40, and 50. The loader, 5, has a light-tight cabinet, 7. The cabinet, 7, has a port, 20, for receiving cassettes, 30, 40, 50. A single port, 20, is shown for this purpose, but a loader can be constructed with multiple ports.

Cutaway views of cassettes, 30, 40, 50, are shown in FIG. 1. Cassettes, 30, 40, 50, have already been loaded with a low crossover sensitometrically asymmetric radiographic element, 100. Cassette, 30, has a top of the cassette housing, 31, front intensifying screen, 33, back intensifying screen, 35, a bottom of the cassette housing, 37, a hinge, 32, and indicia, 39, of the intensifying screens within the cassette. The radiographic element, 100, is loaded between the front intensifying screen, 33, and back intensifying screen, 35, of cassette, 30.

Cassette, 40, has a top of the cassette housing, 41, front intensifying screen, 43, back intensifying screen, 45, a bottom of the cassette housing, 47, a hinge, 42, and indicia, 49. The radiographic element, 100, is loaded between the front intensifying screen, 43, and back intensifying screen, 45, of cassette, 40.

Cassette, 50, has a top of the cassette housing, 51, front intensifying screen, 53, a back intensifying screen, 55, a bottom of the cassette housing, 57, a hinge, 52, and indicia, 59. The radiographic element, 100, is loaded between the front intensifying screen, 53, and back intensifying screen, 55, of cassette, 50.

Figure 2:
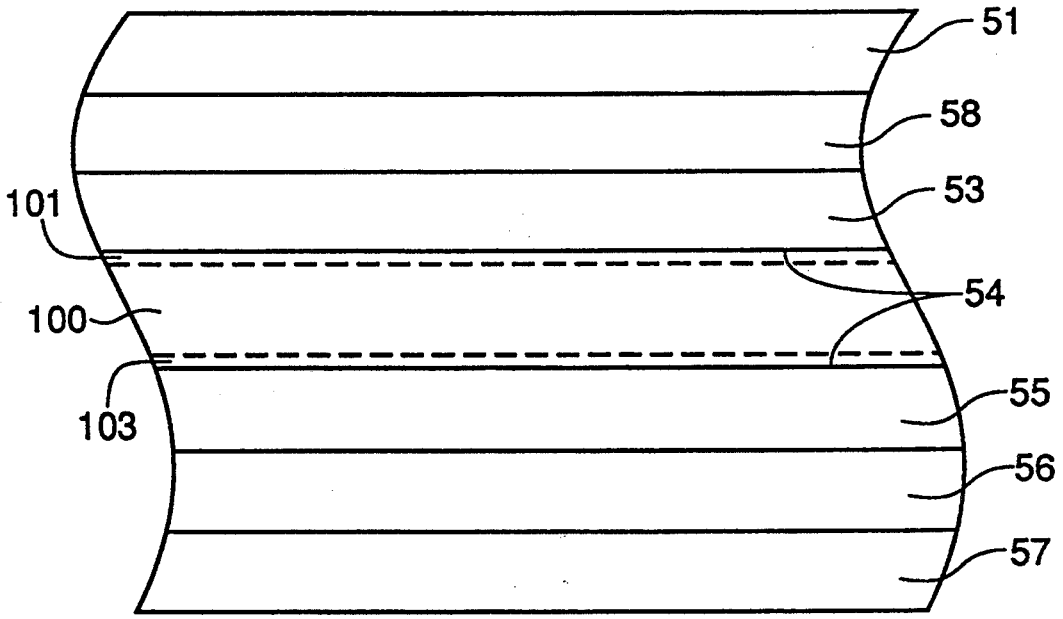
FIG. 2 is a semi-diagramatical cross-sectional view of a cassette.

FIG. 2 is a semi-diagramatical view of a cross-section of cassette, 50, along the line 1-1'shown in FIG. 1, showing several additional features of cassette, 50, and radiographic element, 100, which are not shown in FIG. 1. The additional elements of cassette, 50, are a top cushion layer, 58, a bottom cushion layer, 56, and space, 54, for receiving the radiographic element, 100. The cushion layers, 58, 56, of cassette, 50, are provided to fixedly hold the radiographic element, 100, in pressurized contact with the intensifying screens, 53, 55, when the top and bottom of the cassette housing, 51, 57, are closed together. When the top and bottom of the cassette housing, 51, 57, are closed together they provide a light-tight cassette housing. Also shown in FIG. 2, are the front emulsion layer, 101, and back emulsion layer, 103, of radiographic element, 100.

Cassette, 50, is used for Extremity Imaging, because the photicity ratio of the back emulsion layer, 103-back intensifying screen, 55, to the front emulsion layer, 101-front intensifying screen, 53, is between 2 and 5.

The cross-sectional views of cassettes, 30, and, 40, would be similar to that of cassette, 50, shown in FIG. 2. Cassette, 30, is used for Imaging of Knees and Shoulders, because the photicity ratio of the back emulsion layer, 103-back intensifying screen, 35, to the front emulsion layer, 101-front intensifying screen, 33, is between 5 and 9. Cassette, 40, is used for Imaging of Lateral C-Spines, because the photicity ratio of the the back emulsion layer, 103-back intensifying screen, 45, to the front emulsion layer, 101-front intensifying screen, 43, is between 9 and 16.

Figure 3:
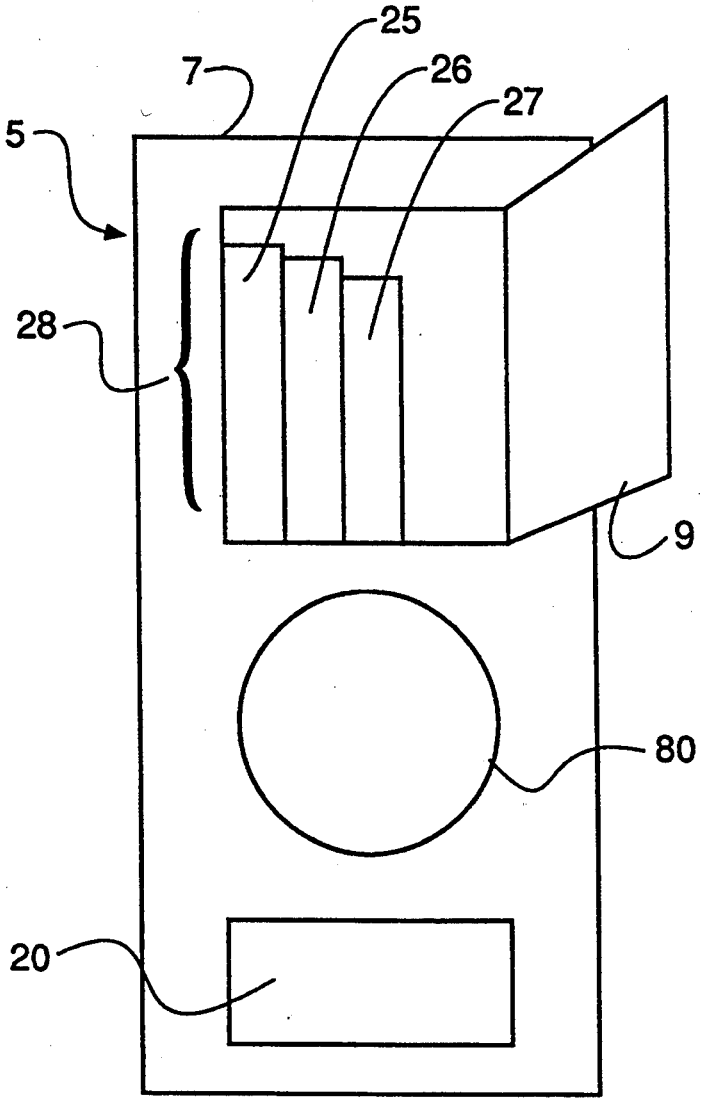
FIG. 3 is a diagramatical view of a loader having a supply of low crossover radiographic elements.

The loader, 5, shown in FIG. 1, for the system of orthopedic imaging, 10, is shown in greater detail in FIG. 3. FIG. 3 shows a loader, 5, that has a light-tight cabinet, 7. The cabinet, 7, has a port, 20, for receiving cassettes (the cassettes are not shown), and an openable panel, 9, (shown open) to access the store, 28, of radiographic elements. Additional panels can be provided for this purpose. The store, 28, is held in separate vertically oriented storage trays, 25, 26, 27. The loader, 5, may be constructed to hold more or fewer storage trays as needed and the storage trays can be constructed to hold any sizes of radiographic elements as desired. It is not required that the storage trays be vertically oriented, as shown; they can be oriented in any direction suitable for the loading mechanism, 80. The loading mechanism, 80, can be any mechanism known in the art for opening a cassette, loading a radiographic element from a store, 28, into a cassette and closing the cassette. Loaders and the loading mechanisms are disclosed in U.S. Pat. Nos. 3,150,263; 3,934,735; 4,047,193; 4,049,142; 4,185,200; 4,201,919; 4,210,816; 4,227,089; 4,694,571; incorporated herein by reference.

One preferred embodiment of the system having a single low crossover asymmetrical radiographic element and at least two cassettes which meet the photicity requirements of this invention is described below.

The single type of radiographic element has a transparent film support, front and back silver halide emulsion layers coated on opposite sides of the film support, and hydrophilic colloid dye layers for reducing the crossover to less than 10 percent. The back silver halide emulsion layer exhibits a speed exceeding by from 0.3 to 1.0 log E that of the front silver halide emulsion layer, the back silver halide emulsion layer exhibits a contrast in the range of from 2.0 to 4.0 and the front silver halide emulsion layer exhibits a contrast in the range of from 0.5 to 1.7. As herein employed, the term "contrast" is the slope of the characteristic curve (a graph of density versus log E) for the symmetrical radiographic element at a reference density of 1.0 and is not an average of contrasts over a range of densities. A particular element which possesses these speed and contrast values is described in greater detail in U.S. patent application Ser. No. 08/192,082, filed herewith and incorporated herein by reference.

The system also consists of at least two of the following three cassettes. The first cassette has a housing, high resolution front and back intensifying screens, and a site disposed between the front and back intensifying screens for receiving one of the just-described radiographic elements into the cassette so that the front and back emulsion layers on the radiographic element are respectively located adjacent the front and back intensifying screens in the cassette. The preferred range of emission ratios of the high resolution front intensifying screen to the high resolution back intensifying screens is 1.0 to between 0.5 and 2.0. This combination of high resolution screens and the just-described low crossover sensitometrically asymmetric radiographic element provides a photicity ratio, as defined above, of between 2 and 5 ideal for Extremity Imaging.

The second cassette has a housing, a high resolution front intensifying screen and a medium resolution back intensifying screen, and a site disposed between the front and back intensifying screens for receiving the radiographic element into said cassette so that the front and back emulsion layers on the radiographic element are respectively located adjacent the front and back intensifying screens in the cassette. The preferred range of emission ratios of the high resolution front intensifying screen to the medium resolution back intensifying screen is 1.0 to between 2.0 and 5.0. This combination of front and back intensifying screens and the low crossover radiographic element provides a photicity ratio, as defined above, of between 5 and 9 ideal for Imaging of Knees and Shoulders.

The third cassette has a housing, a high resolution front intensifying screen and a low resolution back intensifying screen, and a site disposed between the front and back intensifying screens for receiving the radiographic element into said cassette so that the front and back emulsion layers on the radiographic element are respectively located adjacent the front and back intensifying screens in the cassette. The preferable emission ratios of the high resolution front intensifying screen to the low resolution back intensifying screen is 1.0 to greater than 5.0. This combination of front and back intensifying screens and the low crossover radiographic element provides a photicity ratio, as defined above, of between 9 and 16 and the very wide dynamic range required for Imaging of the Lateral C-Spine.

The high resolution intensifying screens in the system described above are intensifying screens which possess a Modulation Transfer Function (MTF) greater than 0.5 at 2 cycles/mm and/or standardized relative emissions between 50 and 150, preferably about 70 and 125. An example of a high resolution intensifying screen that can be used in the system of this invention is Screen Z described in U.S. patent application No. 08/192,082, filed herewith, and incorporated herein by reference. Commercially available high resolution intensifying screens which can be used in the system of this invention include Kodak Lanex Fine or Kodak Min-R Medium screens. The method of measuring MTF and the standardized relative emissions are described below.

The medium resolution intensifying screen in the system described above is a screen which possesses an MTF between 0.3 and 0.5 at 2 cycles/mm and/or standardized relative emissions between about 150 and 450, preferably about 250 and 400. An example of a medium resolution intensifying screen that can be used in the system of this invention is Screen X described in U.S. patent application No. 08/192,082, filed herewith, and incorporated herein by reference. Commercially available medium resolution intensifying screens which can be used in the system of this invention include Kodak Lanex Medium, or Kodak Lanex Regular intensifying screens. The method of measuring MTF and the standardized relative emissions are described below.

The low resolution intensifying screen in the system described above is a screen which possesses an MTF less than 0.3 at 2 cycles/mm and/or standardized relative emissions between about 450 and 800, preferably about 550 and 700. An example of a low resolution intensifying screen that can be used in the system of this invention is Screen W described in U.S. patent application No. 08/192,082, filed herewith, and incorporated herein by reference. Commercially available low resolution intensifying screens which can be used in the system of this invention include Kodak Lanex Fast Back intensifying screens. The method of measuring MTF and the standardized relative emissions are described below.

The MTF's of the screens are measured following the procedure of Doi et al, "MTF's and Wiener Spectra of Radiographic Screen-Film Systems, U.S. Department of Health and Human Services, pamphlet FDA 82-8187. The method is modified as described in Luckey et al U.S. Pat. No. 4,710,637. However, since Luckey et al is measuring MTF's at low energy levels typical of mammography, the following changes are made to obtain MTF's corresponding to more commonly employed energy levels: A 3-phase, 12-pulse generator, with a tungsten-target X-ray tube, is employed at 90 kVp, with 3 mm aluminum filtration. The inherent filtration of the X-ray tube itself is approximately 1 mm aluminum equivalent, bringing the total X-ray beam filtration up to approximately 4 mm aluminum equivalent.

The standardized relative emissions of electromagnetic radiation longer than 370 nm in wavelength for the intensifying screens is determined as follows:

The X-radiation response of each screen is obtained using a tungsten target X-ray source in an XRD 6 TM generator. The X-ray tube is operated at 70 kVp and 30 mA, and the X-radiation from the tube is filtered through 0.5 mmCu and 1 mm Al filters before reaching the screen.

The emitted light is detected by a Princeton Applied Research Model 1422/01 TM intensified diode array detector coupled to an Instruments SA Model HR-320 TM grating spectrograph. This instrument is calibrated to within $\pm 0.5$ nm with a resolution of better than 2 nm (full width at half maximum). The intensity calibration was performed using two traceable National Bureau of Standards sources, which yielded an arbitrary intensity scale proportional to Watts/nm/cm$^2$. The total integrated emission intensity from 250 to 700 nm is calculated on a Princeton Applied Research Model 1460 OMA III TM optical multichannel analyzer by adding all data points within this region and multiplying by the bandwidth of the region.

Actual emission levels are converted to standardized relative emission levels by dividing the emission of each screen by the emission of a high resolution screen and multiplying by 100. The high resolution screen consists of a terbium activated gadolinium oxysulfide phosphor having a median particle size of 5 $\mu$m coated on a blue tinted clear polyester support in a Permuthane TM polyurethane binder at a total phosphor coverage of 3.4 g/dm$^2$ at a phosphor to binder ratio of 21:1 and containing 0.0015% carbon.

The present invention constitutes an improvement over the present way of orthopedic imaging. Now, radiologists can use a single system consisting of a store of low crossover asymmetric radiographic elements, and a plurality of cassettes having various pairs of front and back intensifying screens and obtain optimum X-ray images of bones and useful images of the surrounding flesh for all orthopedic exam types. The store of low crossover sensitometrically asymmetric radiographic elements can be held in a loader which can supply to the radiologist the proper cassette-element assembly for each orthopedic exam type.

The invention has been described in detail with particular reference to preferred embodiments thereof, but it will be understood that variations and modifications can be effected within the spirit and scope of the invention.

What is claimed is:

1. A radiographic system, comprising:

asymmetrical radiographic elements, each said radiographic element having nominally the same composition and at least one emulsion layer on both the back and front sides of a support;

a plurality of cassettes, each said cassette having a housing, front and back intensifying screens and a receiving site for said radiographic element disposed between said front and back intensifying screens;

said cassettes further comprising a first cassette and a second cassette, said first cassette providing a photicity ratio of said back emulsion layer-said back intensifying screen to said front emulsion layer-said front intensifying screen of between 2 and 5 when loaded with said radiographic element so that said front and back emulsion layers on said radiographic elements are respectively located adjacent said front and back intensifying screens in said first cassette; said second cassette providing a photicity ratio of said back emulsion layer-said back intensifying screen to said front emulsion layer-said front intensifying screen of between 5 and 9 when loaded with said radiographic element so that said front and back emulsion layers on said radiographic element are respectively located adjacent said front and back intensifying screens in said second cassette, and said photicity ratios of said first cassette and said second cassette differ by greater than 1 whereby plurality of flesh and bone imaging exam types can be imaged using said radiographic system.

2. The system according to claim 1 wherein said store of low crossover sensitometrically asymmetrical radiographic elements are in a loader.

3. The system according to claim 1 wherein said radiographic element reduces crossover to less than 5 percent.

4. The system according to claim 1, wherein said front and back intensifying screens of said first cassette exhibit a ratio of emissions of 1.0 to between 0.5 and 2.0, respectively, and said front and back intensifying screens of said second cassette exhibit a ratio of emissions of 1.0 to between 2.0 and 5.0, respectively.

5. The system according to claim 1, wherein said front and back intensifying screens of said first cassette each exhibit a Modulation Transfer Function at 2 cycles/mm greater than 0.5, said front intensifying screen of said second cassette exhibits a Modulation Transfer Function at 2 cycles/mm greater than 0.5, and said back intensifying screen of said second cassette exhibits a Modulation Transfer Function at 2 cycles/mm between 0.3 and 0.5.

6. The system according to claim 5, wherein said front and back intensifying screens of said first cassette each exhibit standardized relative emissions between 50 and 150 and said front intensifying screen of said second cassette exhibits standardized relative emissions between 50 and 150 and said back intensifying screen of said second cassette exhibits standardized relative emissions between 150 and 450.

7. The system according to claim 6, wherein said front and back intensifying screens of said first cassette each exhibit standardized relative emissions between 70 and 125 and said front intensifying screen of said second cassette exhibits standardized relative emissions between 70 and 125 and said back intensifying screen of said second cassette exhibits standardized relative emissions between 250 and 400.

8. A radiographic system, comprising:

a store of low crossover sensitometrically asymmetrical radiographic elements, each said radiographic element having nominally the same composition and at least one emulsion layer on both the back and front sides of a support;

a plurality of cassettes, each said cassette having a housing, front and back intensifying screens and a receiving site for said radiographic element disposed between said front and back intensifying screens;

said cassettes further comprising a first cassette and a second cassette, said first cassette providing a photicity ratio of said back emulsion layer-said back intensifying screen to said front emulsion layer-said front intensifying screen of between 5 and 9 when loaded with said radiographic element so that said front and back emulsion layers on said radiographic elements are respectively located adjacent said front and back intensifying screens in said first cassette; said second cassette providing a photicity ratio of said back emulsion layer-said back intensifying screen to said front emulsion layer-said front intensifying screen of between 9 and 16 when loaded with said radiographic element so that said front and back emulsion layers on said radiographic element are respectively located adjacent said front and back intensifying screens in said second cassette, and said photicity ratios of said first cassette and said second cassette differ by greater than 1 whereby plurality of flesh and bone imaging exam types can be imaged using said radiographic system.

9. The system according to claim 8, wherein said store of low crossover sensitometrically asymmetrical radiographic elements are in a loader.

10. The system according to claim 8, wherein said radiographic element reduces crossover to less than 5 percent.

11. The system according to claim 8, wherein said front and back intensifying screens of said first cassette exhibit a ratio of emissions of 1.0 to between 2.0 and 5.0, respectively, and said front and back intensifying screens of said second cassette exhibit a ratio of emissions of 1.0 to greater than 5.0, respectively.

12. The system according to claim 8, wherein said front intensifying screen of said first cassette exhibits a Modulation Transfer Function at 2 cycles/mm greater than 0.5, said back intensifying screen of said first cassette exhibits a Modulation Transfer Function at 2 cycles/mm between 0.3 and 0.5 and said front intensifying screen of said second cassette exhibits a Modulation Transfer Function at 2 cycles/mm greater than 0.5, and said back intensifying screen of said second cassette exhibits a Modulation Transfer Function at 2 cycles/mm less than 0.3.

13. The system according to claim 12, wherein said front intensifying screen of said first cassette exhibits standardized relative emissions between 50 and 150 and said back intensifying screen of said first cassette exhibits standardized relative emissions between 150 and 450 and said front intensifying screen of said second cassette exhibits standardized relative emissions between 50 and 150 and said back intensifying screen of said second cassette exhibits standardized relative emissions between 450 and 800.

14. The system according to claim 13, wherein said front intensifying screen of said first cassette exhibits standardized relative emissions between 70 and 125 and said back intensifying screen of said first cassette exhibits standardized relative emissions between 250 and 400 and said front intensifying screen of said second cassette exhibits standardized relative emissions between 70 and 125 and said back intensifying screen of said second cassette exhibits standardized relative emissions between 550 and 700.

15. A radiographic system, comprising:

a store of low crossover sensitometrically asymmetrical radiographic elements, each said radiographic element having nominally the same composition and at least one emulsion layer on both the back and front sides of a support;

a plurality of cassettes, each said cassette having a housing, front and back intensifying screens and a receiving site for said radiographic element disposed between the front and back intensifying screens;

said cassettes further comprising a first cassette and a second cassette, said first cassette providing a photicity ratio of said back emulsion layer-said back intensifying screen to said front emulsion layer-said front intensifying screen of between 2 and 5 when loaded with said radiographic element so that said front and back emulsion layers on said radiographic element are respectively located adjacent said front and back intensifying screens in said first cassette; said second cassette providing a photicity ratio of said back emulsion layer-said back intensifying screen to said front emulsion layer-said front intensifying screen of between 9 and 16 when loaded with said radiographic element so that said front and back emulsion layers on said radiographic element are respectively located adjacent said front and back intensifying screens in said second cassette whereby a plurality of flesh and bone imaging exam types can be imaged using said radiograghic system.

16. The system according to claim 15, wherein said store of low crossover sensitometrically asymmetrical radiographic elements are in a loader.

17. The system according to claim 15, wherein said radiographic element reduces crossover to less than 3 percent.

18. The system according to claim 15, wherein said front and back intensifying screens of said first cassette exhibit a ratio of emissions of 1.0 to between 0.5 and 2.0, respectively, and said front and back intensifying screens of said second cassette exhibit a ratio of emissions of 1.0 to greater than 5.0, respectively.

19. The system according to claim 15, wherein said front and back intensifying screens of said first cassette each exhibit a Modulation Transfer Function at 2 cycles/mm greater than 0.5, said front intensifying screen of said second cassette exhibits a Modulation Transfer Function at 2 cycles/mm greater than 0.5, and said back intensifying screen of said second cassette exhibits a Modulation Transfer Function at 2 cycles/mm less than 0.3.

20. The system according to claim 19, wherein said front and back intensifying screens of said first cassette each exhibit standardized relative emissions between 50 and 150 and said front intensifying screen of said second cassette exhibits standardized relative emissions between 50 and 150 and said back intensifying screen of said second cassette exhibits standardized relative emissions between 450 and 800.

21. The system according to claim 20, wherein said front and back intensifying screens of said first cassette each exhibit standardized relative emissions between 70 and 125 and said front intensifying screen of said second cassette exhibits standardized relative emissions between 70 and 125 and said back intensifying screen of said second cassette exhibits standardized relative emissions between 550 and 700.

22. The system of claim 1, further comprising a third cassette which provides a photicity ratio of said back emulsion layer-said back intensifying screen to said front emulsion layer-said front intensifying screen of between 9 and 16, and said photicity ratios of said first cassette, said second cassette, and said third cassette differ by greater than b 54076849.001 1.

23. The system according to claim 22, wherein said front and back intensifying screens of said first cassette exhibit a ratio of emissions of 1.0 to between 0.5 and 2.0, respectively, said front and back intensifying screens of said second cassette exhibit a ratio of emissions of 1.0 to between 2.0 and 5.0, respectively, and said front and back intensifying screens of said third cassette exhibit a ratio of emissions of 1.0 to greater than 5.0, respectively.

24. The system according to claim 22, wherein said front and back intensifying screens of said first cassette each exhibit Modulation Transfer Functions at 2 cycles/mm greater than 0.5, said front intensifying screen of said second cassette exhibits a Modulation Transfer Function at 2 cycles/mm greater than 0.5, said back intensifying screen of said second cassette exhibits a Modulation Transfer Function at 2 cycles/mm between 0.3 and 0.5, said front intensifying screen of said third cassette exhibits a Modulation Transfer Function at 2 cycles/mm greater than 0.5, and said back intensifying screen of said third cassette exhibits a Modulation Transfer Function at 2 cycles/mm less than 0.3.

25. The system according to claim 24, wherein said front and back intensifying screens of said first cassette exhibit standardized relative emissions between 50 and 150, said front intensifying screen of said second cassette exhibits standardized relative emissions between 50 and 150 and said back intensifying screen of said second cassette exhibits standardized relative emissions between 150 and 450 said front intensifying screen of said third cassette exhibits standardized relative emissions between 50 and 150 and said back intensifying screen of said third cassette exhibits standardized relative emissions between 450 and 800.

* * * * *

UNITED STATES PATENT AND TRADEMARK OFFICE

CERTIFICATE OF CORRECTION

PATENT NO. : 5,407,790

DATED : April 18, 1995

INVENTOR(S) : Robert E. Dickerson et al

It is certified that error appears in the above-indentified patent and that said Letters Patent is hereby corrected as shown below:

Col. 12, line 25, remove "b 54076849.001".

Signed and Sealed this

Twenty-seventh Day of June, 1995

*Attest:*

Bruce Lehman

BRUCE LEHMAN

*Attesting Officer*

*Commissioner of Patents and Trademarks*